US006966134B2

(12) United States Patent
Ngan

(10) Patent No.: US 6,966,134 B2
(45) Date of Patent: Nov. 22, 2005

(54) POCKET CALENDAR

(76) Inventor: Chi Lung Ngan, 5 Bradford Rd., Edison, NJ (US) 08820

( * ) Notice: Subject to any disclaimer, the term of this patent is extended or adjusted under 35 U.S.C. 154(b) by 0 days.

(21) Appl. No.: 10/725,392

(22) Filed: Dec. 3, 2003

(65) Prior Publication Data

US 2005/0120599 A1 Jun. 9, 2005

(51) Int. Cl.[7] ..... G09D 3/02
(52) U.S. Cl. ..... 40/122; 40/537
(58) Field of Search ..... 40/649, 775, 537, 40/107, 122, 119, 121; 283/2; D19/22

(56) References Cited

U.S. PATENT DOCUMENTS

| | | | | | |
|---|---|---|---|---|---|
| 296,934 | A | | 4/1884 | Cussons | |
| 376,506 | A | | 1/1888 | Bate | |
| 443,894 | A | | 12/1890 | Blackmer | |
| 1,320,683 | A | * | 11/1919 | Goodhue | 40/537 |
| 1,477,464 | A | | 12/1923 | Spragens | |
| 1,683,996 | A | * | 9/1928 | Snow | 150/147 |
| 1,879,260 | A | * | 9/1932 | Howard | 40/107 |
| 2,220,927 | A | * | 11/1940 | Zalkind | 229/74 |
| 2,316,797 | A | | 4/1943 | Lichter | |
| 2,436,105 | A | | 2/1948 | Fisler | |
| 2,626,817 | A | * | 1/1953 | Winford | 283/2 |
| 2,626,819 | A | | 1/1953 | Winford | |
| 2,898,257 | A | * | 8/1959 | Carver | 156/289 |
| 3,032,904 | A | | 5/1962 | Washburn | |
| 3,491,471 | A | * | 1/1970 | Semple | 40/703 |
| 3,534,489 | A | | 10/1970 | Diambra et al. | |
| 3,759,305 | A | * | 9/1973 | McIntyre | 150/149 |
| 3,850,083 | A | * | 11/1974 | Falcon | 493/188 |
| 4,275,517 | A | * | 6/1981 | Blanchard | 40/773 |
| 4,301,962 | A | * | 11/1981 | Monckton et al. | 229/72 |
| 4,419,837 | A | * | 12/1983 | Meeker | 40/359 |
| 4,458,435 | A | * | 7/1984 | Ackerman | 40/530 |
| 4,794,711 | A | * | 1/1989 | Christensen | 40/122 |
| 4,948,034 | A | * | 8/1990 | Rohloff | 229/92.8 |
| 5,263,523 | A | * | 11/1993 | Scheunemann | 150/132 |
| 5,412,886 | A | * | 5/1995 | Quinn | 40/119 |
| 5,513,457 | A | * | 5/1996 | Byrnes et al. | 40/405 |
| 5,797,204 | A | * | 8/1998 | Paulos | 40/122 |
| 6,126,317 | A | * | 10/2000 | Anderson et al. | 383/207 |
| 6,161,321 | A | * | 12/2000 | Huber | 40/789 |
| 6,267,234 | B1 | * | 7/2001 | Bergh et al. | 206/308.1 |
| 6,442,878 | B1 | * | 9/2002 | Letterio | 40/124.4 |
| 6,655,647 | B1 | * | 12/2003 | Williams | 248/346.01 |

* cited by examiner

*Primary Examiner*—Brian K. Green
*Assistant Examiner*—Paul Royal, Jr.
(74) *Attorney, Agent, or Firm*—Shlesinger, Arkwright & Garvey LLP

(57) ABSTRACT

A pocket chamber calendar and an assembly blank therefor which calendar is provided with a slit entering into said chamber for receiving a notice or the like so that a portion of the notice when positioned in the pocket chamber extends outwardly therefrom for ease in removal.

4 Claims, 4 Drawing Sheets

POCKET CALENDAR

FIELD OF THE INVENTION

This invention relates to a pocket chamber calendar and the assembly blank for producing the calendar. The calendar includes a slit into which a notice can be positioned in the pocket chamber of a calendar so as to allow the notice to extend outwardly from the slit for ease in removal once deposited.

BACKGROUND OF THE INVENTION

Calendars with pockets of various types are well known as noted by the 1884 U.S. Pat. No. 296,934 of Cussons and subsequent early patents of Bate U.S. Pat. No. 376,506 of 1888 and Blackmer U.S. Pat. No. 443,894 of 1890. Subsequently patents were granted on calendars to Spargens U.S. Pat. No. 1,477,464; Lichter U.S. Pat. No. 2,316,797; Fisler U.S. Pat. No. 2,436,105; Winford U.S. Pat. No. 2,626,817 and U.S. Pat. No. 2,626,819 Washburn U.S. Pat. No. 3,032, 904; Diambra U.S. Pat. No. 3,534,489 and Quinn U.S. Pat. No. 5,412,886. Of these patents, Quinn provides a calendar with slots for receiving a notice with means for limiting the insertion of the notice so that a portion projects from the slot.

OBJECTS AND SUMMARY OF THE INVENTION

It is an object of this invention to provide a pocket chamber calendar provided with a slit rather than a slot which permits ease of entry of a notice or the like which may be inserted into the slit for reception in a chamber formed in the calendar.

Yet a further object of this invention is to provide a blank assembly which may be manufactured inexpensively from calendar board without the removal of slot forming material.

A further object of this invention is to provide a pocket chamber calendar with an article receiving slit which bends inwardly at the slightest pressure and does not require buckling of the material in order to permit entry of the notice or the like.

Still another object of this invention is to provide a one-piece assembly blank, which when folded and secured as by glue or other fastening means, provides a pocket chamber with slit means for receiving a notice or the like.

Another object of this invention is to provide a pocket chamber calendar which includes one or more slits for receiving multiple items as desired in the pocket chamber of the calendar.

A further object of this invention is to provide a pocket chamber calendar which has printed information indicia on front and back of the calendar which is capable of being printed simultaneously on only one side of the blank prior to assembly of the calendar by folding.

Another object of this invention is to provide a pocket chamber calendar blank which includes means for wall hanging of the calendar.

In summary, this invention relates to a pocket chamber calendar and the assembly blank therefor which is a one-piece blank which may be formed and glued to provide a pocket for receiving a notice which is inserted into a slit on the front panel of the calendar.

Other objects will be apparent from the following description which includes the drawings identified as follows.

FIGS. 1 THROUGH 5

Figure 1:
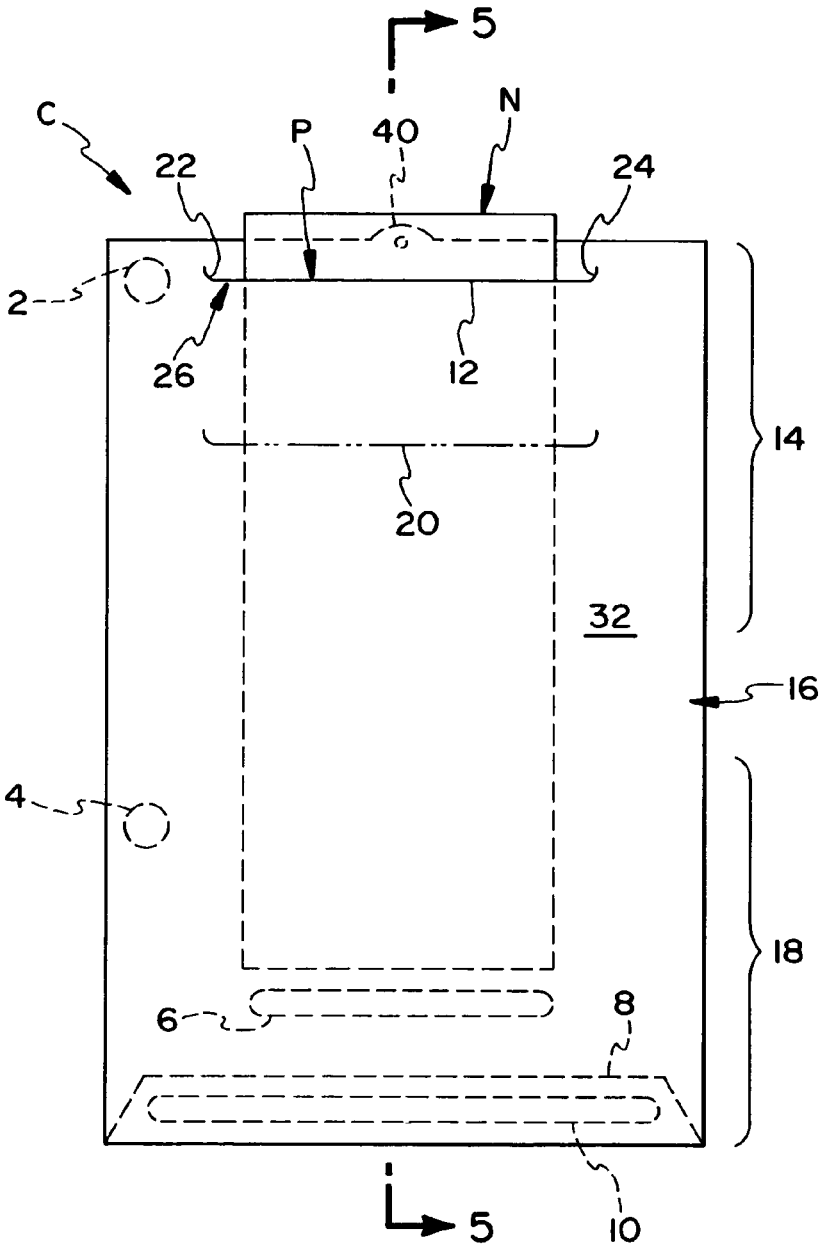
FIG. 1 is a top plan view of the calendar with an insert notice positioned in the calender with portions shown in phantom lines.

In FIG. 1, the pocket chamber calendar C is shown with a notice N which may be an insert such as an envelope, travel card, ticket or the like. Glue areas 2 and 4 are shown in phantom lines on the left side in FIG. 1. A stop 6 shown in phantom lines limits the insertion of the notice N. A turned in flap 8, shown in phantom lines, includes a glue area 10. U-shape slit 12 is provided on the upper portion 14 of the front panel 16. The stop 6 and the glue area 10 are on the lower portion 18. The front panel 16 may have additional slits such as 20 shown in phantom lines spaced from the slit 12. The U-shaped slit 12 and other similar slits such as 20 have curved upwardly and outwardly extending legs 22 and 24 legs 22 and 24 may extend vertically straight upwardly rather than being curved as illustrated. Legs 22 and 24 permit ease of insertion of the notice or envelope N or the like. Instead of having to pucker a straight slit for insertion of a notice or the like, the legs 22 and 24 serve to act as a pivot creating a flap 26 which readily bends inwardly upon insertions of the notice N or the like.

Figure 5:
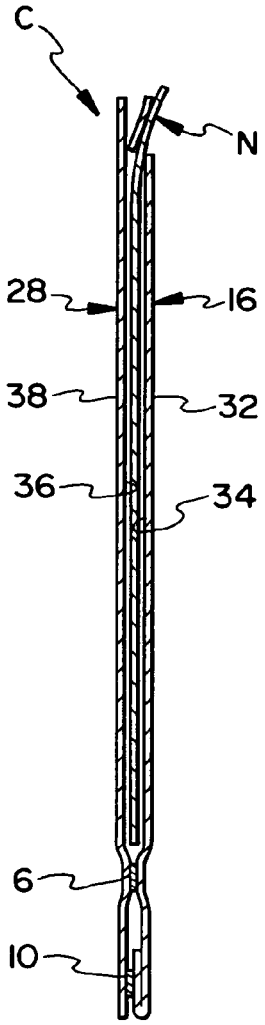
FIG. 5 is a cross-sectional view showing the folded pocket chamber calendar.
Figure 2:
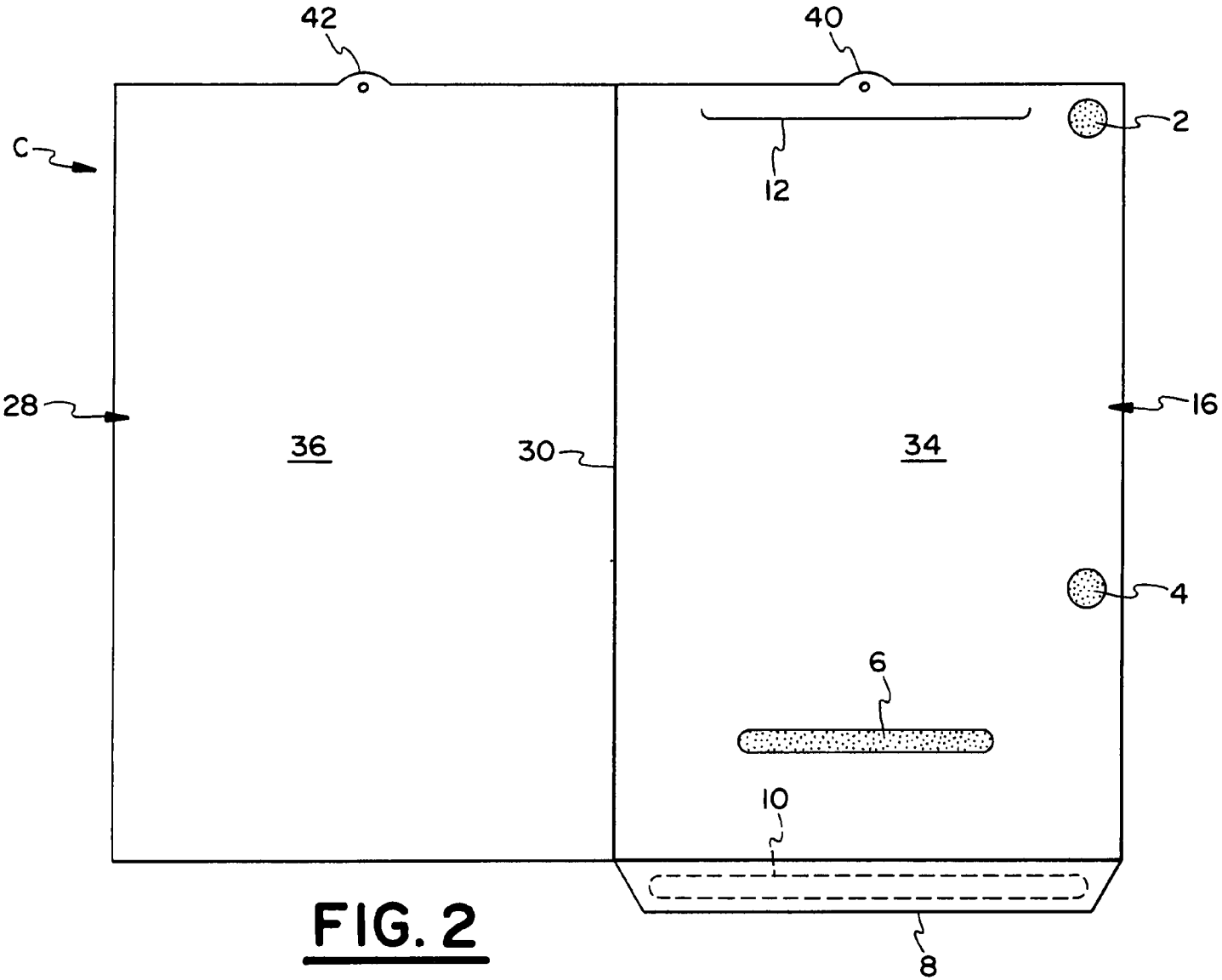
FIG. 2 is a top plan view of the blank for forming the calendar and prior to folding.

Referring now to FIG. 2, you will observe that the calendar C is formed from a single blank B having the front panel 16 and the back panel 28. A central fold line 30 is provided between the front panel 16 and back panel 28. As shown in FIG. 5, the front panel 16 has a front side 32 and a back side 34. Back panel 28 has a front side 36 and back side 38. On the top of the panels 16 and 28 are wall hangers 40 and 42 which are shown as projecting tabs which may receive a nail or other fixture.

Figure 3:
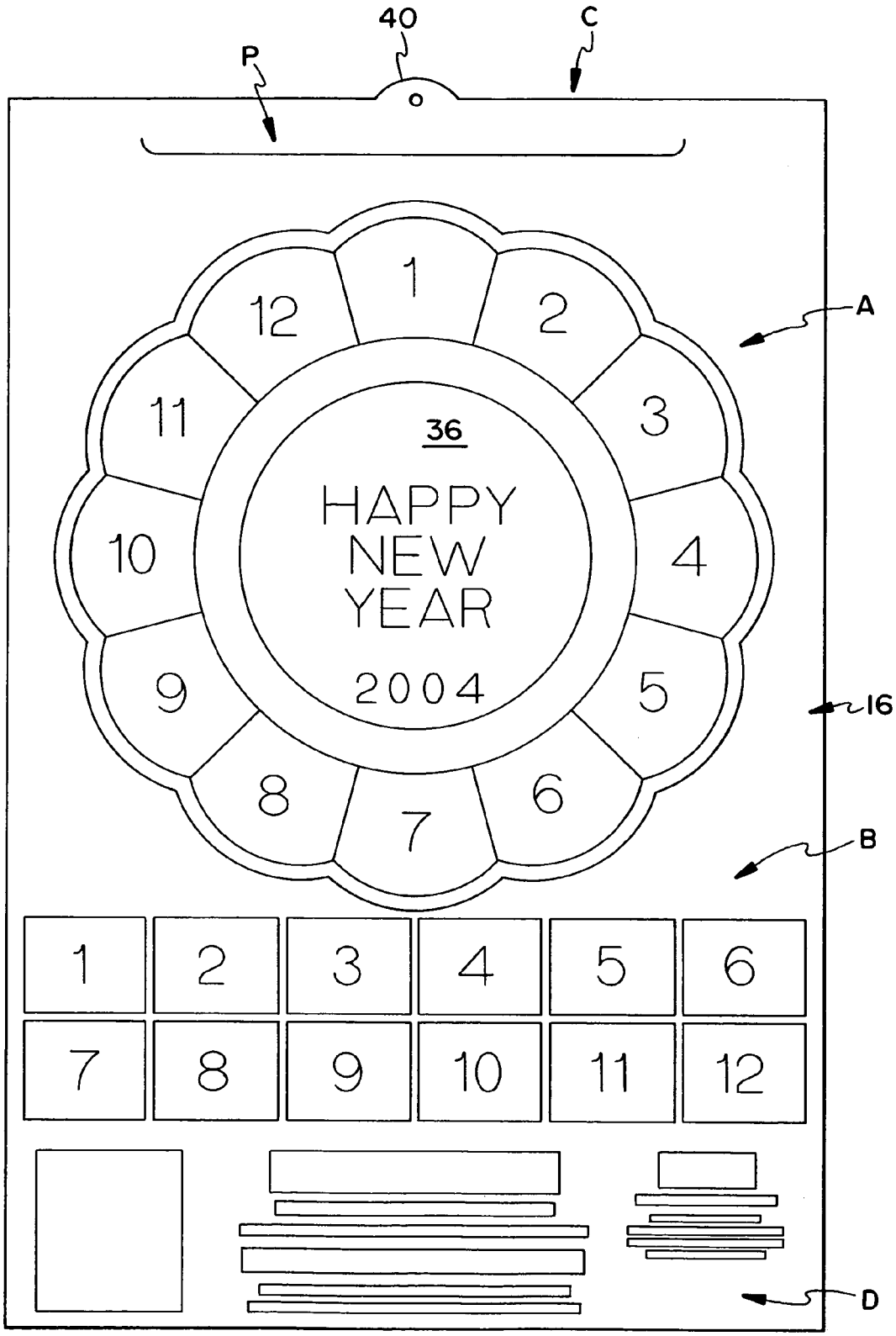
FIG. 3 is top plan view of the calendar showing in general indicia thereon.
Figure 4:
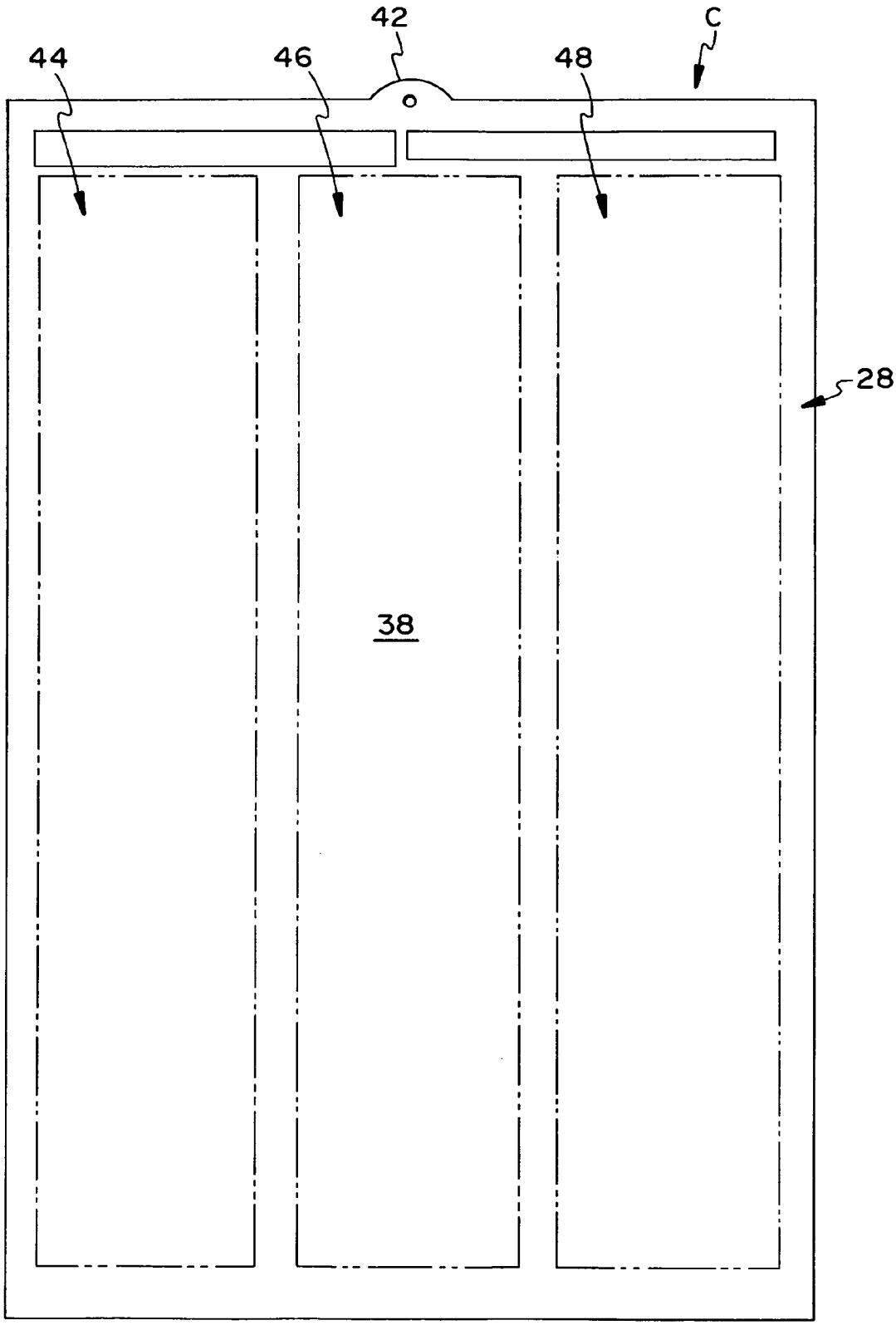
FIG. 4 is a back plan view of the calendar showing areas which will include indicia thereon.

The blank B is shown in FIG. 2 with the flap 8 on the front panel 16. The flap 8 could be on the back panel 28. The glue areas as shown in the drawings could be spot glued areas or line glue areas or some other securement or fastening means such as staples or the like. Glue areas are preferred to other fastening and securement means. The stop 6 could be a glue strip binding the front panel 16 to the back panel 28 to provide spacing between panels 16 and 28. The glue on pre-assembly of the blank B may be on the back panel 28 or both panels 16 and 28. When the panels 16 and 28 are brought together and the sides and bottom edges are connected, a pocket chamber P is produced. As shown in FIG. 3, the pocket chamber calendar C will include indicia A, B and D such as noted. The days and months of year B will be shown in the straight line boxes 1–12 and the graphic descriptions of the Chinese years A would be shown in the circular arrangement 1 through 12. Beneath the month and date calendar area would be additional indicia D including the proprietor, address and telephone information. The back panel 28 as shown in FIG. 4 would include additional indicia such as columns indicating a menu of food items. Three columns 44, 46 and 48 are illustrated in FIG. 4.

It will be obvious that the calendar could be made of two separate individual panels such as 16 and 28 glued together at their side edges. The blank B as shown in FIG. 2 is more readily assembled into the calendar C and reduces the cost of manufacturing by having a single part rather than two parts which would be put together. The purpose of the flap 8 is to permit spacing between the front and back panels 16 and 28 permitting ease in insertion of items N of some thickness when the two panels 16 and 28 are brought together thus permitting further ease in inserting of any notice, envelope, ticket or the like N. The positioning of the stop 6, which may be on either the panel 16 or the panel 28 or both, will determine the amount a notice N extends outwardly through the slit 12.

While this invention has been described as having a preferred design, it is understood that it is capable of further modifications, and uses and/or adaptions of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A pocket chamber calendar assembly blank for receiving a notice with a portion of the notice when positioned in the pocket chamber extending outwardly therefrom for ease in removal comprising:

a) front and back panels;

b) said front and back panels each having front and back sides, and upper and lower portions;

c) said front and back panels being substantially the same dimensions with said front panel positionable over and coextensional with said back panel and connectable thereto;

d) said front and back panels having bottom, left and right side edges, which when positioned coextensively, are interconnected and form a pocket chamber having upper and lower pockets and passageways connecting said upper and lower pocket;

e) said front panel having a U-shaped slit on said upper portion extendable into said pocket chamber and extending from adjacent said front panel left and right side edges and serving as an opening into said pocket chamber for a notice to be easily inserted therein when said front and back panels are interconnected;

f) one of said front and back panels lower portions including a glue strip stop for limiting the depth of insertion of a notice and for bonding together said front and back panels a distance less than the width of a notice to be received in said pocket chamber and extending parallel to said U-shaped slit and of a length substantially less than said U-shaped slit;

g) said front and back panels being integral and joined by a fold line forming the right edge of said front and back panels and including glue means for securing said left edges together when said panels are positioned for forming said pocket chamber calendar;

h) one of said panels bottom edge having a foldable flap positioned a substantial distance beneath said glue strip stop and forming the bottom of said pocket chamber and extending from adjacent said panels' left side edge to adjacent said panels' right side edge and substantially longer than said U-shaped slit;

i) said foldable flap having a glue strip substantially the length of said foldable flap and longer than said glue strip stop to permit spacing between said front and back panels when said blank is assembled into said pocket chamber calendar for ease of insertion of a notice into said pocket chamber; and j) said glue strip stop having ends spaced a substantial distance from said side edges of said panels thereby preventing binding when a notice inserted into said pocket chamber is positioned against said glue strip stop and permitting ease in release from said pocket chamber when a notice is removed from against said glue strip stop.

2. A pocket chamber calendar for receiving a notice with a portion of the notice when positioned in the pocket chamber extending outwardly therefrom for case in removal comprising:

a) front and back panels;

b) said front and back panels each having front and back sides and upper and lower portions;

c) said front and back panels being substantially the same dimensions with said front panel positioned over and coextensive with said back panel and connected thereto;

d) said front and back panels having bottom, left and right side edges connected and forming a pocket chamber;

e) said front panel having a U-shaped slit on said upper portion extending into said pocket chamber and adjacent said front panel left and right side edges and serving as an opening into said pocket chamber for a notice to be easily inserted therein;

f) said front and back panels lower portions including a glue strip stop for limiting the depth of insertion of a notice and bonding together said front and back panels a distance less than the width of a notice to be received in said pocket chamber arid extending parallel to said U-shaped slit and of a length substantially less than said U-shaped slit;

g) the bottom edge on one of said panels having a foldable flap folded inward and forming the bottom of said pocket chamber positioned a substantial distance beneath said glue strip stop and inserted between said front arid back panels and forming the bottom of said pocket chamber and extending from adjacent said panels' left edges to adjacent said panels' right edges and substantially longer than said U-shaped slit;

h) said foldable flap having a glue strip secured to the other of said panels substantially the length of said foldable flap and longer than said glue strip stop to permit spacing between said front and back panels for ease of insertion of a notice into said pocket chamber; and i) said glue strip stop having ends spaced a substantial distance from said side edges of said panels thereby preventing binding when a notice inserted into said pocket chamber is positioned against said glue strip stop and permitting ease in release from said pocket chamber when a notice is removed from against said glue strip stop.

3. A pocket chamber calendar as in claim 2 and wherein:

a) said front panels' front side includes space for two different printed calendars.

4. A pocket chamber calendar as in claim 3 and wherein:

a) said back panels' front side includes space for a printed menu.

* * * * *